United States Patent [19]

Kreit et al.

[11] Patent Number: 4,866,807

[45] Date of Patent: Sep. 19, 1989

[54] TOOTHBRUSH

[76] Inventors: Erwin Kreit, Talstrasse 8; Hans Ineichen, Schwanderhofstrasse 11, both of CH-6020 Emmenbrucke, Switzerland

[21] Appl. No.: 159,494

[22] Filed: Feb. 16, 1988

Related U.S. Application Data

[63] Continuation-in-part of Ser. No. 59,755, Jun. 8, 1987.

[30] Foreign Application Priority Data

Jun. 9, 1986 [CH] Switzerland ..... 2326/86

[51] Int. Cl.[4] ..... A46B 9/04

[52] U.S. Cl. ..... 15/105; 15/167.1; 84/94.2; 434/263

[58] Field of Search ..... 15/167 R, 167 A, 105; 434/263; 446/76, 81; 84/101, 94 R, 95 R, 94 C; 128/359, 360

[56] References Cited

U.S. PATENT DOCUMENTS

| | | | |
|---|---|---|---|
| 2,601,244 | 6/1952 | Boulicault | 132/92 R |
| 4,554,919 | 11/1985 | Hubert | 128/360 |
| 4,607,747 | 8/1986 | Steiner | 84/94 C |
| 4,788,734 | 12/1988 | Bauer | 15/167.1 |

FOREIGN PATENT DOCUMENTS

| | | | |
|---|---|---|---|
| 3149233 | 4/1983 | Fed. Rep. of Germany | 15/167 R |

*Primary Examiner*—Peter Feldman

*Attorney, Agent, or Firm*—Browdy and Neimark

[57] ABSTRACT

The tooth brush comprises a figurehead detachably fixed to a handle. The head contains a module with at least one pushbutton, a loudspeaker, a digital sound generator and a battery (19). When the button is pressed, a tune is generated by the sound generator for a particular period of time and played back through the loudspeaker. This design makes the toothbrush less expensive to produce and makes it easier for children to become accustomed to regular and thorough cleaning of their teeth.

7 Claims, 2 Drawing Sheets

TOOTHBRUSH

This is a continuation-in-part application of U.S. Ser. No. 59,755 filed on June 8, 1988, now abandoned.

BACKGROUND OF THE INVENTION

A toothbrush according to the prior art is known from German Auslegescrift No. 3,149,233. A battery is moduled onto the end of the stem. This head houses a miniature tape recorder and a loudspeaker. After actuation of a pushbutton, the tape recorder plays a tune for 2 to 3 minutes and then rewinds automatically. This is intended to make the cleaning of teeth more attractive to children and above all they are to be encouraged to clean their teeth for a sufficient period of time. This proposal lacks, in particular, practical feasibility. Up until now, a miniature tape recorder having the small dimensions necessary has not been developed. Furthermore, the assembly and wiring of the individual electronic components is complex.

The invention is based on the object of further developing a toothbrush that can be made less expensively than the prior art toothbrush. This object is achieved by providing the signal generator as a digital sound generator, wherein the sound generator, the battery, the pushbutton and the loudspeaker are housed in a module arranged in the head, the head being detachably fixed to the stem.

BRIEF DESCRIPTION OF THE DRAWINGS

An exemplary embodiment of the invention is explained below with reference to the drawing, in which.

Figure 1:
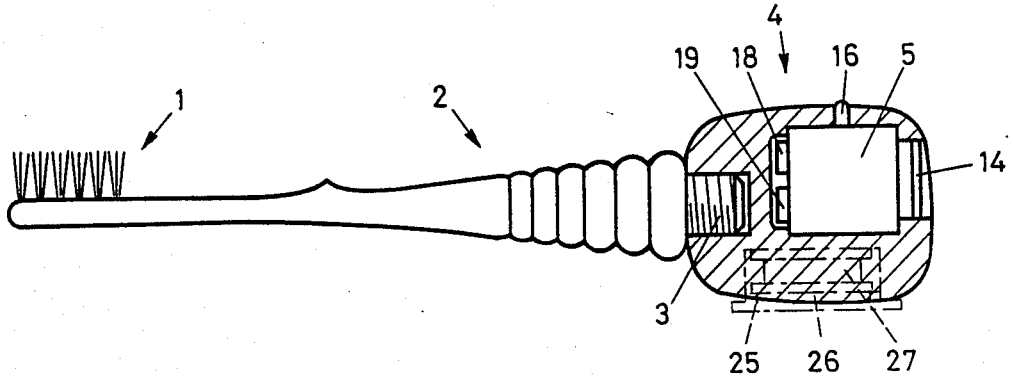
FIG. 1 shows a side view of the toothbrush, partially in section.
Figure 2:
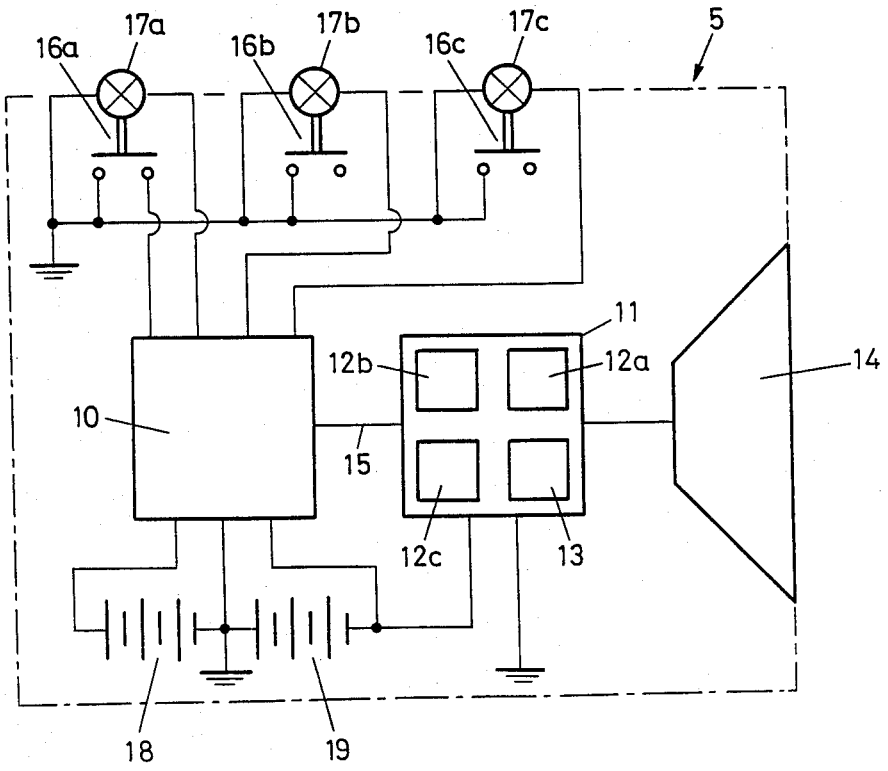
FIG. 2 shows a circuit diagram of the electronic module of the toothbrush according to FIG. 1.

The toothbrush according to FIG. 1 has a brush body 1 and a handle 2, at the free end of which an external thread 3 is moulded on. A figurehead 4 is screwed onto this thread 3. The head 4 houses an electronic module 5, the circuit diagram of which is shown in FIG. 2 according to a first embodiment of the invention. The head 4 is expediently sealed water-tight.

The module 5 comprises a control unit 10, a digital sound generator 11 with three individual chips 12*a*, 12*b*, 12*c*, in each of which four tunes of 2 to 3 minutes duration are stored, and a digital voice synthesizer 13 for the issuing of cleaning instructions at certain intervals within the period of time during which a tune plays in each case. The sound generator 11 is connected to a loudspeaker 14 and via a control line 15 to the control unit 10. The input to the control unit 10 is via three illuminated pushbuttons 16*a*, 16*b*, 16*c*, each with a light-emitting diode 17*a*, 17*b*, 17*c* of different colours. Control unit 10 and sound generator 11 are powered by two batteries 18, 19, the one battery 18 serving operation of the light-emitting diodes, while the other battery 19 supplies the electronics of the control unit 10 and the sound generator 11.

Figure 3:
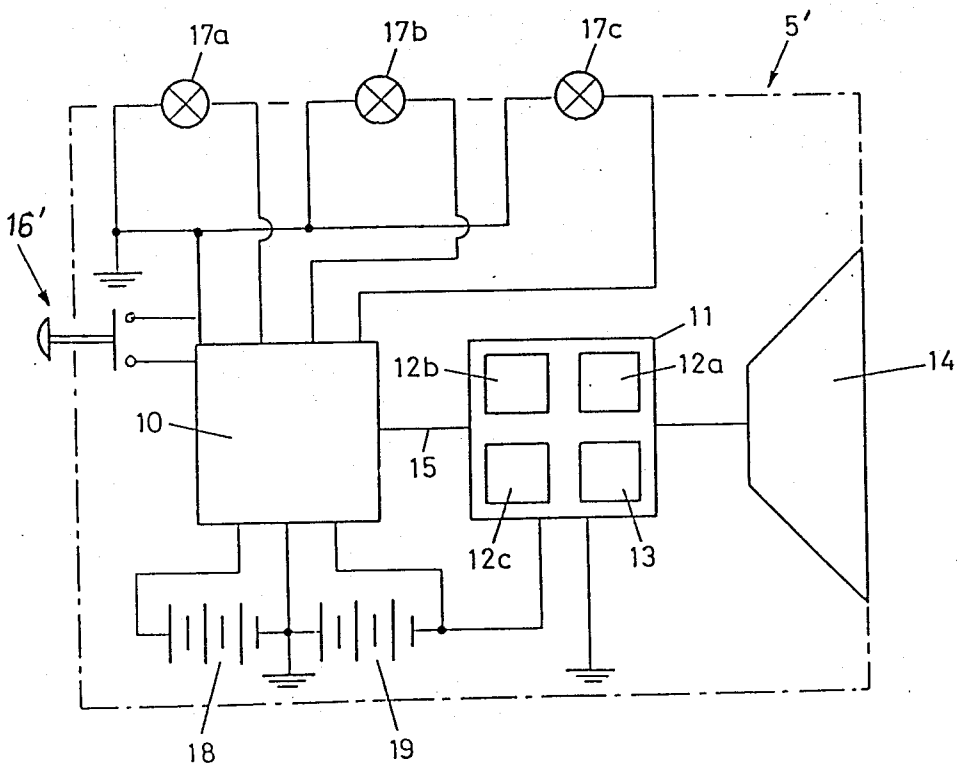
FIG. 3 is a circuit diagram of the electronic module according to another embodiment of the present invention.

The embodiment shown in FIG. 3 differs from the embodiment of FIG. 2 in that the module 5′ contains a single pushbutton switch 16, and the three light emitting diodes 17*a*, 17*b*, 17*c* of different colors are rigidly mounted to the housing of module 5′. In the three chips 12*a*, 12*b*, 12*c*, different types of tunes are stored, i.e., in chip 12*a* morning tunes, in chip 12*b*, midday tunes and in chip 12*c* bedtime tunes. When the switch 16′ is pressed the next time then the tunes stored in the next chip 12*b* are played and so on.

The embodiment has proved to be of great pedagogic value in that the children are reminded by their toothbrush of forgotten brushings when they next operate the brush. When, e.g., a child has not brushed his/her teeth after lunch this will be noticed in the evening when the wrong type of tunes are played by the brush.

The function of the toothbrush shown is as follows.

At the beginning of cleaning teeth, one of the three buttons 16*a*, 16*b*, 16*c* is depressed, namely depending on the time of day, morning, midday, evening. By means of the actuated button 16*a*, 16*b*, 16*c*, the corresponding individual chip 12*a*, 12*b*, 12*c* with a repertoire of tunes suitable for the time of day is selected via the control unit 10, a tune is called up from the repertoire and played. During the playing period, the tune is periodically interrupted for the issuing of cleaning instructions by means of the voice synthesizer 13, for example "bottom left outside, bottom middle outside etc.", for example at intervals of approximately 15 seconds. During the playing duration of the tune, the light-emitting diode 17*a*, 17*b*, 17*c* assigned to the depressed button 16*a*, 16*b*, 16*c* remains switched-on, and the reception of signals of the buttons 16*a*, 16*b*, 16*c* by the control unit 10 is blocked.

The digital sound generator 11 with the chips 12*a*, 12*b*, 12*c* and the voice synthesizer 13 has a low power requirement and can be made very small so that the entire module 5 can be constructed as a cube having an edge length of just 2 cm. The same module 5 can be installed in heads 4 of various shapes which, at low costs, makes it possible to produce a range of heads satisfying different tastes. Since the head 4 is connected detachably to the handle 2, it may also be used by children for playing. This is of great pedagogical advantage if it is time for cleaning teeth by using play. In addition, in this way the toothbrush can be exchanged when it has become worn out without having to throw away the figurehead at the same time.

The figurehead 4 can also be used to house a reservoir 26, which can be closed by means of a cover 25, with a reel 27 with dental floss, indicated by dot-dashed lines in FIG. 1. This makes the dental floss available at any time it is needed during the cleaning of teeth.

We claim:

1. A toothbrush comprising:

a handle having a figure head fixed thereon;

a single pushbutton for the generation of a acoustic signal generated during a predetermined period of time by an acoustic signal generator;

a battery;

a loudspeaker;

a module, arranged in the figurehead, housing said signal generator, said battery, said pushbutton and said loudspeaker;

wherein said head is detachably fixed to the handle and said signal generator comprises a digital sound generator having stored a first set of tunes, a second set of tunes distinguishable from the tunes of the first set, and a third set of tunes distinguishable from the tunes of the first and second sets, wherein after pressing of said pushbutton the tunes of one of the three sets are played during said period, and after pressing the pushbutton the next time the tunes of the next consecutive set of tunes are played during said period.

2. The toothbrush according to claim 1, wherein said figurehead is screwed onto said handle.

3. The toothbrush according to claim 1, wherein said sound generator comprises a digital voice synthesizor which issues vocal instructions after intervals within the predetermined period of time.

4. The toothbrush according to claim 1, wherein said figurehead contains a closable reservoir having therein a dental floss reel.

5. The toothbrush according to claim 1, further comprising three light emitting diodes of different colors mounted on said module, on of said diodes lighting up during said period.

6. A toothbrush comprising:

a handle having a figurehead fixed thereon;

a module, arranged in said figurehead, housing an acoustic signal generator, and a loudspeaker;

said acoustic signal generator comprising a digital sound generating means for generating a first set of tunes over a first predetermined term, a second set of tunes distinguishable from said first set of tunes over a second predetermined term, and a third set of tunes distinguishable from said first and second sets of tunes over a third predetermined term;

a single pushbutton on said figurehead for controlling operation of said acoustic signal generator; and said digital sound generating means comprising a control circuit including means sequentially generating said first set of tunes upon a first depression of said pushbutton, said second set of tunes upon a second depression of said pushbutton and said third set of tunes upon a third depression of said pushbutton.

7. A toothbrush according to claim 6 further comprising three light emitting diodes and means for lighting up a different one of said diodes during each of said terms.

* * * * *